US008584263B1

(12) United States Patent
Younger

(10) Patent No.: US 8,584,263 B1
(45) Date of Patent: Nov. 19, 2013

(54) DECORATIVE WEARING ACCESSORIES INCLUDING RECONSTITUTED LEATHER BOARD

(76) Inventor: Kathleen Anne Younger, Los Angeles, CA (US)

( * ) Notice: Subject to any disclaimer, the term of this patent is extended or adjusted under 35 U.S.C. 154(b) by 0 days.

(21) Appl. No.: 13/317,517

(22) Filed: Oct. 20, 2011

(51) Int. Cl.
*A41D 20/00* (2006.01)
*A41B 7/00* (2006.01)
*A44C 5/00* (2006.01)

(52) U.S. Cl.
USPC ..... 2/170; 2/123; 63/3; 63/3.1

(58) Field of Classification Search
USPC ..... 2/170, 60, 66, 123, 162, 244; 63/3, 3.1, 63/3.2, 11; 368/282
See application file for complete search history.

(56) References Cited

U.S. PATENT DOCUMENTS

| | | | | | |
|---|---|---|---|---|---|
| 1,097,024 | A | * | 5/1914 | Holverson | 2/124 |
| 1,840,047 | A | * | 1/1932 | Mealy | 63/3 |
| 1,849,741 | A | * | 3/1932 | Doppenschmitt | 63/3 |
| 2,191,314 | A | * | 2/1940 | Davis | 224/168 |
| 2,427,119 | A | * | 9/1947 | Bensel | 2/338 |
| 2,573,055 | A | * | 10/1951 | Pedersen | 224/178 |
| 2,649,230 | A | * | 8/1953 | Thompson | 368/286 |
| 3,063,058 | A | * | 11/1962 | Vollet | 2/338 |
| 3,086,529 | A | * | 4/1963 | Munz et al. | 606/203 |
| 3,373,445 | A | * | 3/1968 | O'Neill | 2/170 |
| 3,520,001 | A | * | 7/1970 | Chancellor, Jr. | 2/123 |
| 3,790,168 | A | * | 2/1974 | Hashimoto | 473/62 |
| 4,087,989 | A | * | 5/1978 | Taran | 63/11 |
| 4,144,594 | A | * | 3/1979 | Chapman | 2/338 |
| 4,340,976 | A | * | 7/1982 | Wright | 2/338 |
| RE32,566 | E | * | 12/1987 | Patton, Jr. | 2/16 |
| 5,092,067 | A | * | 3/1992 | Prout | 40/633 |
| 5,113,533 | A | * | 5/1992 | Takada | 2/170 |
| 5,150,475 | A | * | 9/1992 | Hansen et al. | 2/16 |
| 5,212,966 | A | * | 5/1993 | Minami | 63/3 |
| 5,980,060 | A | * | 11/1999 | Chien | 362/103 |
| 6,588,019 | B1 | * | 7/2003 | Whittle, Jr. | 2/16 |
| 6,782,648 | B1 | * | 8/2004 | Mosher, Jr. | 40/633 |
| 2007/0094776 | A1 | * | 5/2007 | Stevens et al. | 2/338 |
| 2010/0137701 | A1 | * | 6/2010 | Papastefanou | 600/390 |

* cited by examiner

*Primary Examiner* — Amber Anderson

(57) ABSTRACT

The invention incorporates the use of reconstituted leather board in decorative wearing accessories such as cuffs, belts, necklaces, hat bands, headbands, bracelets, decorative chokers, vests and other wearing accessories for personal use and adornment worn by both men and women. Reconstituted leather board is incorporated into decorative wearing accessories so that the decorative wearing accessory is made stronger and more durable and at the same time also is more malleable and can be formed into a desired shape and maintain that shape through continuous wear.

3 Claims, 12 Drawing Sheets

DECORATIVE WEARING ACCESSORIES INCLUDING RECONSTITUTED LEATHER BOARD

BACKGROUND OF THE INVENTION

1. Field of the Invention

The present invention relates to the field of decorative wearing accessories such as jewelry items and various garments including bracelets, necklaces, belts worn as decorative accessories, headbands, hat bands, chokers, cuffs, vests and other decorative wearing apparel which can contain precious or semiprecious stones.

2. Description of the Prior Art

In general, to the best of the present inventor's knowledge, no one has created any of the products which are discussed in this application out of reconstituted leather.

Reconstituted leather or bonded leather is a man-made material composed of eight percent to one hundred percent leather fibers. It consists of collagen fibers obtained from macerated hide pieces bonded together with latex binders constructed into a fibrous mat to create a look and feel similar or sometimes identical to that of genuine leather.

Examples of products that are most commonly constructed out of bonded leather are bibles, diaries, art books, desk accessories, handbags, chairs and sofas.

Reconstituted leather or bonded leather is a material made of varying degrees of genuine leather combined with other substances to give the appearance of leather at reduced costs. There are different types of bonded leather, but the type being using on upholstered furniture today is a polyurethane or vinyl product backed with fabric and then a layer of latex or other material mixed with a small percentage of leather fibers in the product backing material. The actual leather content of bonded or reconstituted leather varies from manufacturer to manufacturer.

There is a significant need for an improved jewelry item and wearing accessory which incorporates the use of reconstituted leather or in particular to reconstituted leather board, to enhance the benefits of the jewelry and wearing accessory item.

SUMMARY OF THE INVENTION

The present invention incorporates the use of reconstituted leather board in decorative wearing accessories such as cuffs, belts, necklaces, hat bands, headbands, bracelets, decorative chokers, vests and other wearing accessories for personal use and adornment worn by both men and women.

It has been discovered according to the present invention that by incorporating reconstituted leather board into decorative wearing accessories, the decorative wearing accessory is made stronger and more durable and at the same time is also more malleable so that it can be shaped and formed into a desired shape and maintain that shape through continuous wear.

In its preferred embodiment, the reconstituted leather board forms the core or basis of the decorative wearing apparel and is enveloped by various covering members which serve to conceal the interior bonded leather board which serves the purpose of making the jewelry item or wearing apparel item more malleable and strong.

It has further been discovered according to the present invention that the incorporation of reconstituted leather board into a decorative wearing apparel item such as jewelry strengthens the decorative wearing apparel item and enables it to be formed into various desired wearing shapes such as cuffs which can be worn by a woman wearing a sleeveless dress or alternatively, worn over the sleeves of a dress or sweater or other long sleeved garment to help beautify and enhance the aesthetic appearance of the wearer.

For the cuff, the decorative wearing accessory comprises a reconstituted leather board core to which is affixed a button stud closure member which extends through an opening formed or punched into the reconstituted leather board core and is retained to the reconstituted leather board by affixation means such as a threaded bolt extending into a threaded receiving opening in the bulb headed closing member. The back end of the affixation means is concealed by a foam padding layer affixed to the rear surface of the reconstituted leather board core. An upper top layer of suede leather is affixed at its interior surface to the foam core by affixation means such as glue or sewing and then a lower layer of suede leather has a hole punched through it, which hole is press fit over the bulb head of the button stud closing member and affixed to the lower surface of the reconstituted leather board by means such as glue to form a completely enclosed jewelry member. Another hole is punched through the top suede leather surface, the foam core, the reconstituted leather board cord and the lower suede surface so that the bulb head of the button stud closing member is pressed through the second hole to form a generally cylindrical object of any desired circumferential design to form a cuff worn on a person's wrist with the bulb head which closes the cuff hidden inside the cuff. The top exterior surface can be decorated with any desired ornamentation such as large stones affixed to the top surface and held firmly by affixation through strong sewing thread or cord firmly sewn into the top suede leather surface, through the foam core and into the reconstituted leather board by strong stitching. Alternatively, a secondary ornamentation piece is affixed to the top suede leather surface and the ornamentation piece can retain light ornamentation such as smaller jewels such as pearls. A decoration on the circumference of the secondary ornamentation such as rat tail cord or other ribbon decoration can further enhance the beauty of the jewelry piece. The ornamentation piece can also be made of satin or any other fine fabric.

While the cuff is one of the more complicated pieces of jewelry to make, a suede leather belt with an exterior suede leather surface and an interior suede leather surface which surround a reconstituted leather board core is also within the spirit and scope of the present invention. The same button stud closure or a belt buckle and holes for the belt engagement member is all that is required. Any ornamentation can be placed on the exterior suede leather surface. The foam core is optional. The circumference can be encircled with a cord or with a trim affixed around the exterior suede leather surfaces.

Earrings with an outer and inner suede leather surface surrounding a reconstituted leather board core are also within the spirit and scope of the present invention, clip-on means or pierced earring pins can be affixed to the rear surface of the suede leather and further retained by retaining means affixed into the reconstituted leather board core.

It is therefore an object of the present invention to create decorative wearing accessories including jewelry items and garment items which have as their core reconstituted leather board enveloped by a decorative outer material such as suede leather skin, satin cord, or other fine material on both the top and bottom of the item such as suede or leather below the reconstituted leather and/or above the reconstituted leather, which decorative items further serve to retain items of adornment such as turquoise stones or other gems which are sewn onto or stitched into the covering and embedded in the reconstituted leather board to strengthen the bond between the decorative stones and the reconstituted leather board Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
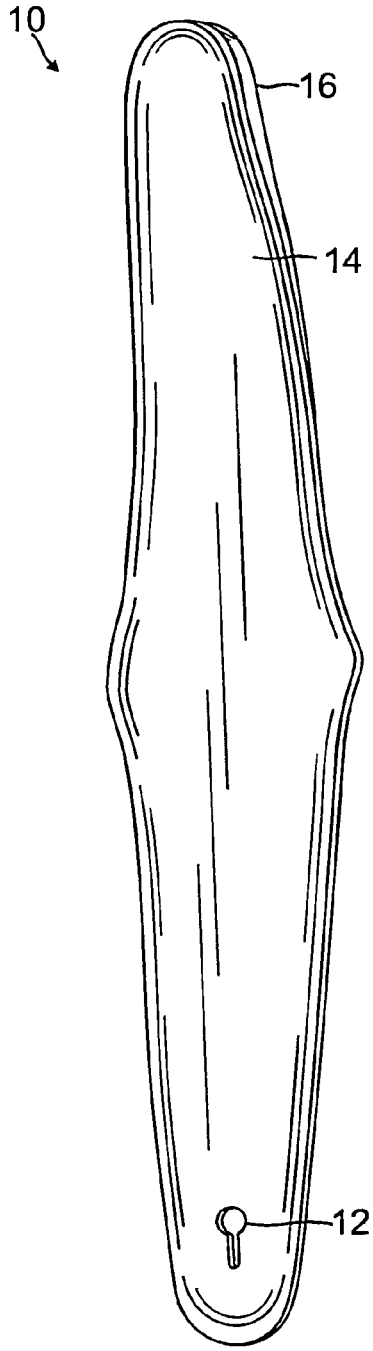
FIG. 1 is a top plan view of an interior core reconstituted leather board used as the interior strengthening member of a cuff with a fanciful circumferential shape designed to match the fanciful circumferential shape of the cuff.
Figure 2:
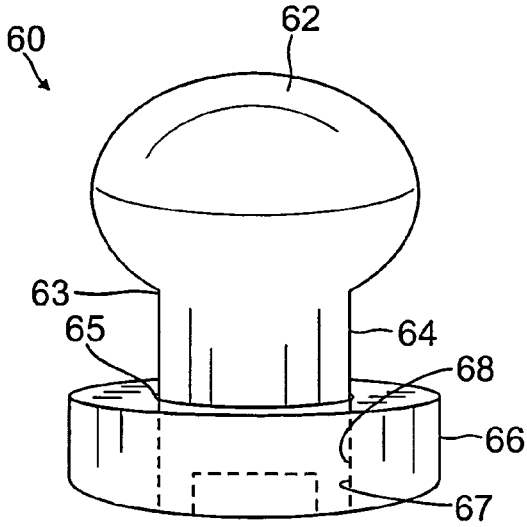
FIG. 2 is a side perspective view of a closing button stud closing member used to close the cuff, and illustrating the ball shaped head, the stem and a bottom base having interior threads.
Figure 3:
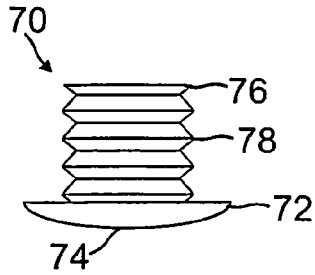
FIG. 3 is a side perspective view of a threaded bolt having a base with a screwdriver receiving opening.

Referring to FIG. 1, there is illustrated an interior layer of the present invention reconstituted leather board 10 which is cut into the shape of the jewelry piece to be manufactured, which in the present case is a cuff. An opening 12 is punched through the entire thickness of the reconstituted leather board extending from the upper surface 14 to the lower surface 16. Referring to FIG. 2, a button stud closing member 60 includes a ball shaped head 62 affixed to one end of 63 of a stem 64 which in turn at its second end 65 is affixed to a base 66 having an interior cavity 68 with a threaded interior surface 67. Referring to FIG. 3, a threaded bolt 70 having a base 72 with a screwdriver opening 74 extends to a stem 76 having mating threads 78.

Figure 4:
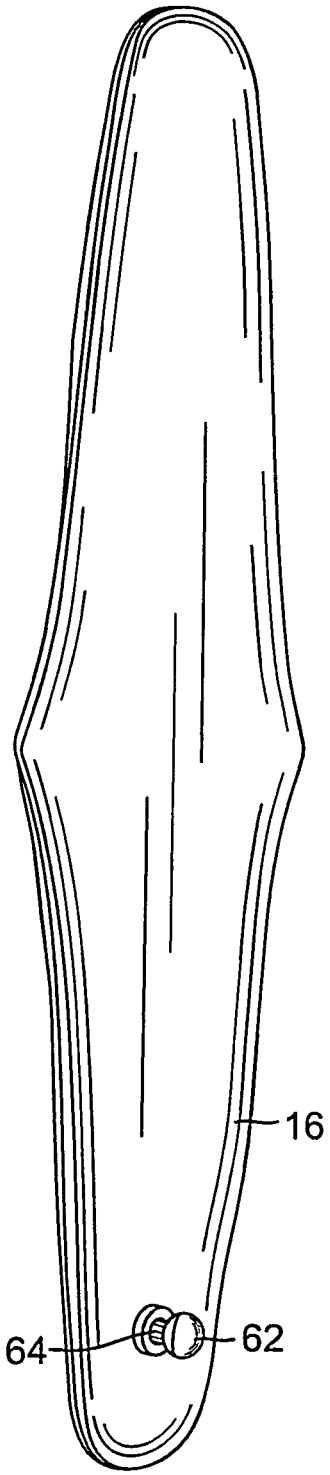
FIG. 4 is a bottom plan view of the reconstituted leather board core with the button stud closing member extending through the reconstituted leather board core with the ball shaped head extending from the bottom surface of the reconstituted leather board core.
Figure 5:
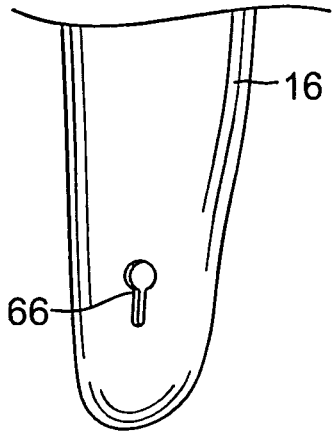
FIG. 5 is a partial top plan view of the reconstituted leather board core illustrating the bottom of the threaded bolt which lies against the top surface of the reconstituted leather board core and which affixes the button stud closing member to the reconstituted leather board core.
Figure 6:
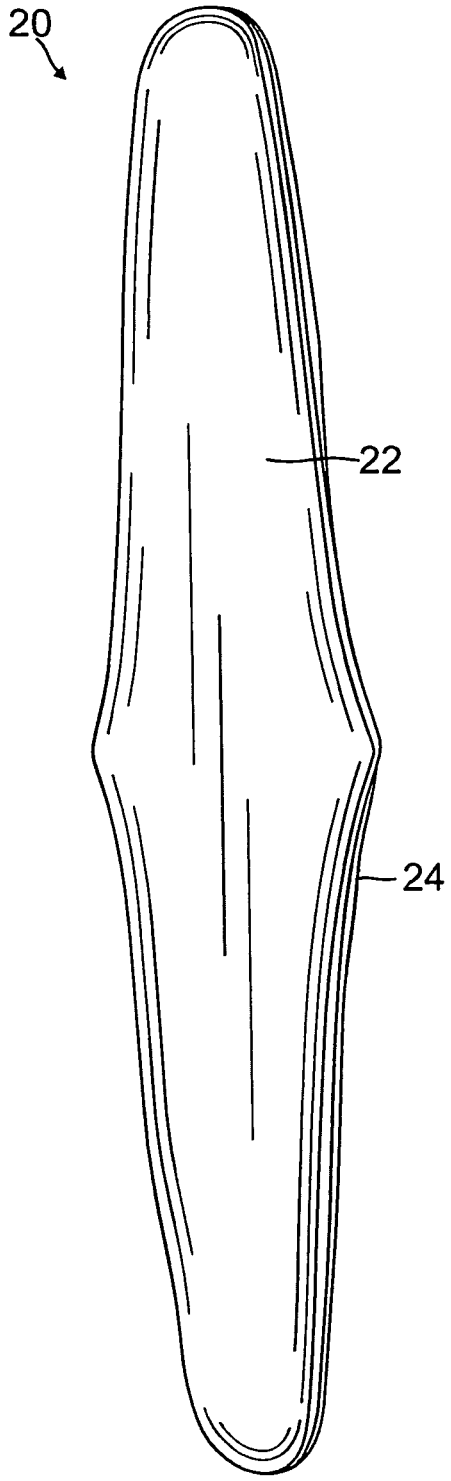
FIG. 6 is a top plan view of a foam core which is affixed at its bottom surface to the top surface of the reconstituted leather board core, the foam core in the same shape as the reconstituted leather board core.

Referring to FIG. 4, the ball shaped head 62 and stem 64 are pushed through opening 12 from the upper surface 14 to the rear or lower surface 16 so that the stem 64 and ball shaped head 62 extend away from the rear or lower surface 16. Referring to FIG. 5, the base 66 extends through to the rear surface 16 and threaded bolt 70 has its stem 76 inserted into threaded opening 68 so that threads 78 are threaded into interior threads 67 so that the bolt base 72 and screwdriver opening 74 are against the front surface 14 of the reconstituted leather board core 10. A screwdriver is used to screw threaded bolt 70 into the button stud closing member 60. Referring to FIG. 6, a foam core 20 which is formed in the same shape as the reconstituted leather board core 10 is then glued to the front surface 14 of the reconstituted leather board 10 so that it conceals the bolt base 72, screwdriver opening 74 and base 66 of the button stud closing member 60.

Figure 7:
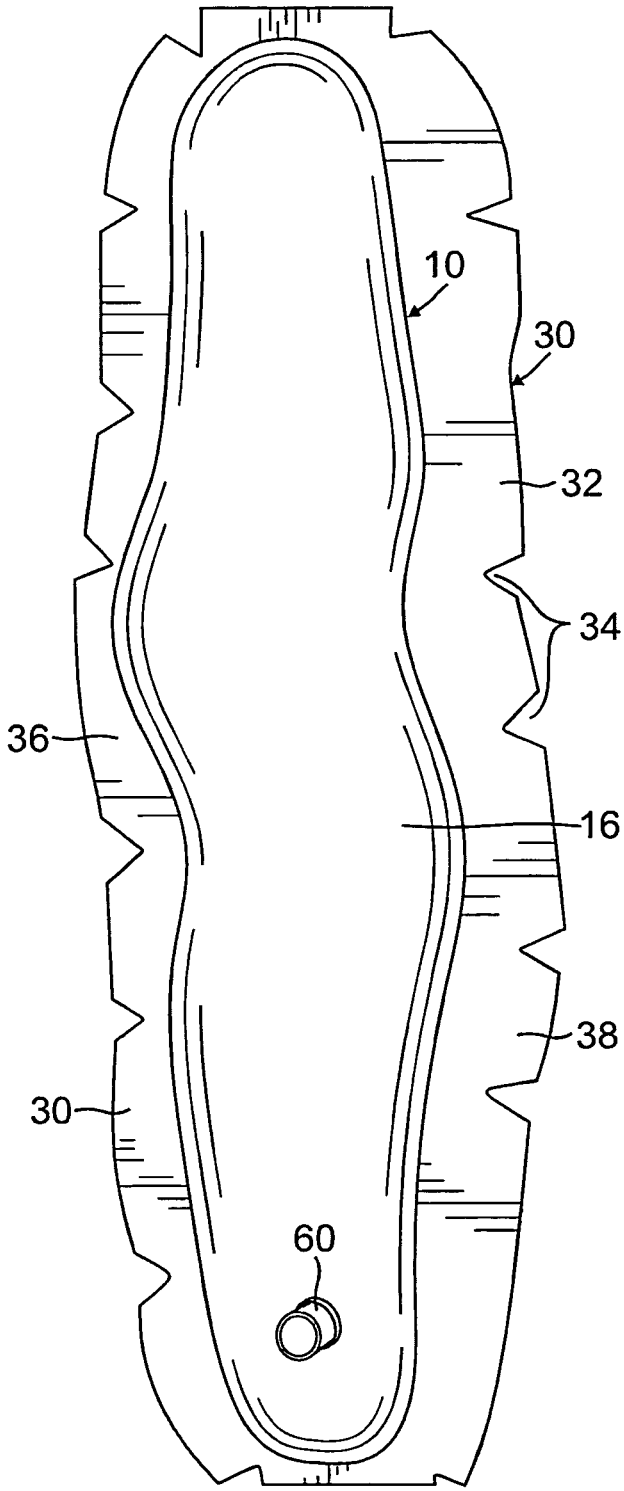
FIG. 7 is a bottom plan view of the combined reconstituted leather board and glued on foam placed face down so that the foam leather piece is against the interior surface of top exterior suede leather surface with a multiplicity of odd shaped cuts cut into the top surface suede leather to form cutout areas in the top suede leather to facilitate glueing of the top suede leather surface to the rear surface of the reconstituted leather board.

Referring to FIG. 7, the combined reconstituted leather board 10 and glued on foam 20 are placed face down so that the foam core 20 is against the interior surface 32 of top exterior suede leather surface 30 with a multiplicity of odd shaped cuts 34 cut into the top surface suede leather 30 to form cutout areas 36 in the top suede leather to facilitate glueing of the top suede leather surface 30 to the rear surface 16 of the reconstituted leather board.

Figure 8:
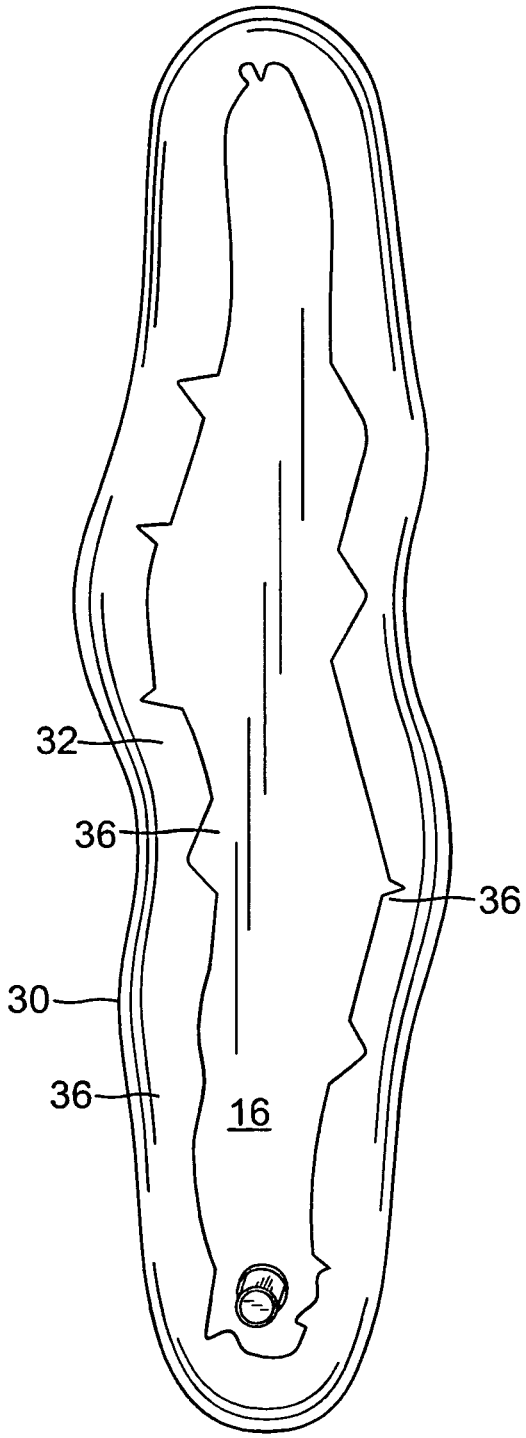
FIG. 8 is a bottom plan view of the interior of the top suede leather surface glued to the rear surface of the reconstituted leather board core.

Referring to FIG. 8, glue or other affixation means 38 is placed onto the cutout areas 36 of rear surface 32 of the exterior top suede leather 30 so that the cutout areas 36 are glued or otherwise affixed to the rear surface 16 of reconstituted leather board 10.

Figure 9:
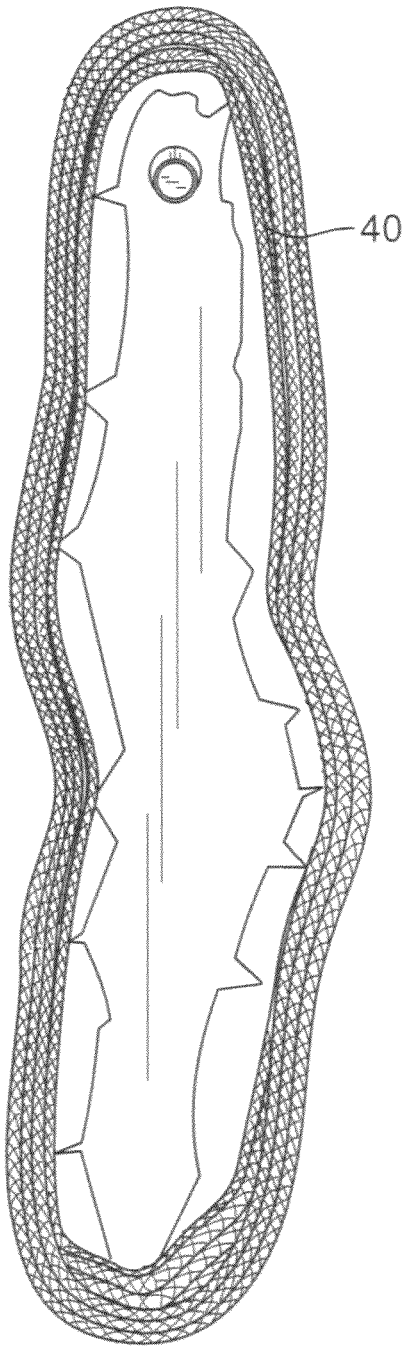
FIG. 9 is a bottom plan view of a silver metal cord glued around the exterior circumferential area of the top suede leather surface and foam core so that the silver metal cord is entirely surrounds the top surface of top suede leather.

Referring to FIG. 9, a metallic cord 40 which has an interior tape by which it is then glued between the foam core 20 and upper top suede leather member 30 (see FIG. 13) so that the metallic cord 40 surrounds the top suede leather portion 30 and a portion of the foam core 20.

Figure 10:
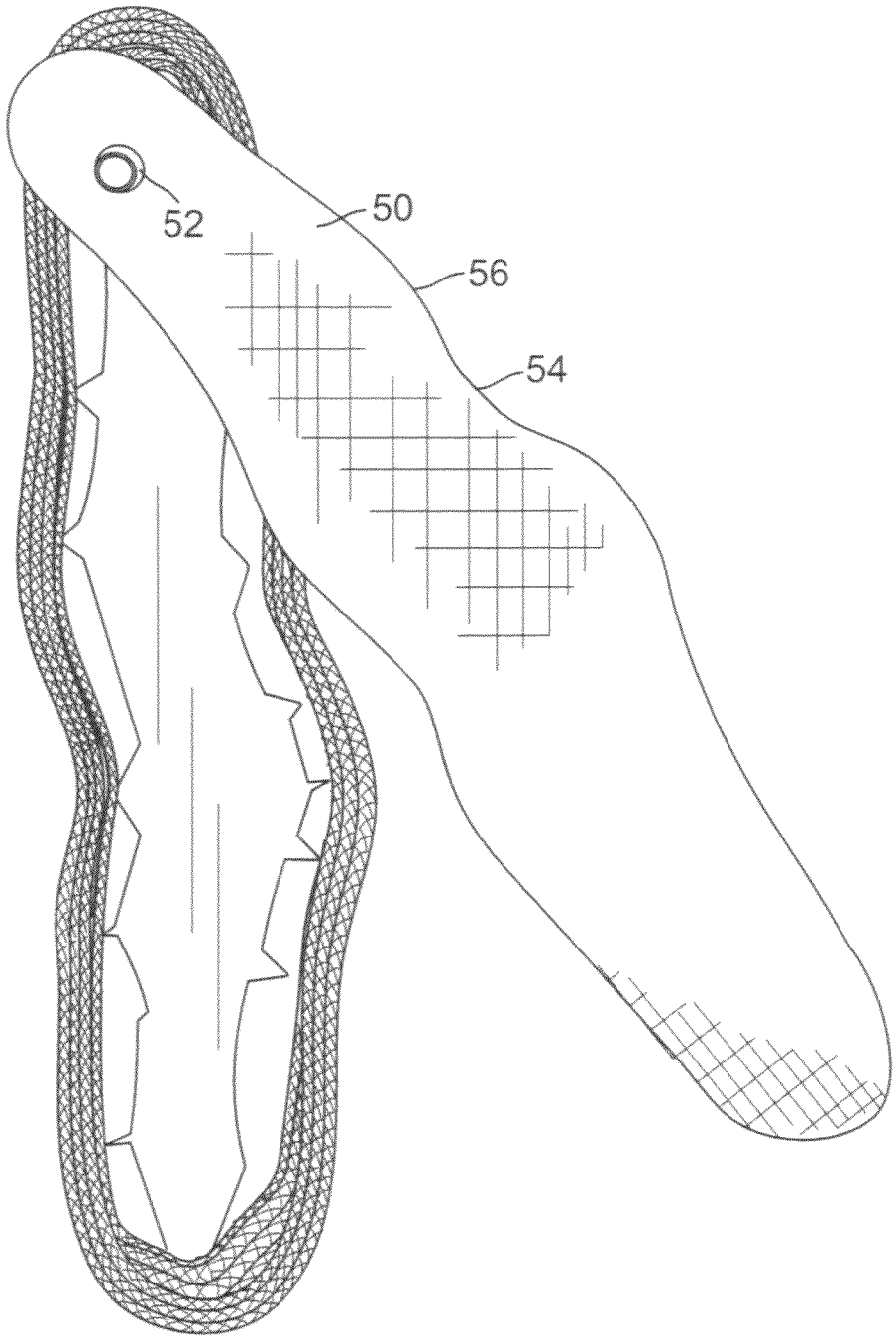
FIG. 10 is a bottom perspective view of the bottom suede leather surface with a hole punched into it and fed onto and through the top ball of the button stud closing member so that it rests around the stem and is then rotated so that its circumference is adjacent to the silver metal cord and is glued in place by glue applied to the interior surface and along the circumference of the bottom suede leather surface so that the bottom suede leather surface is glued to the interior surface of the reconstituted leather core and to the cutout portion of the outer suede leather surface so that the silver metal cord surrounds the entire exterior circumference of the top suede leather surface and a portion of the foam core.

Referring to FIG. 10, rear or bottom suede leather surface 50 has a hole 52 punched into it and is fed onto and through the top ball 62 of button stud closing member 60 so that it rests around the stem 64 and is then rotated so that its circumference 54 is adjacent to the silver metal cord 40 and is glued in place by glue applied to the interior surface 56 of the bottom suede leather surface so that the bottom suede leather surface 50 is glued onto the bottom surface 16 of reconstituted leather core board 10, and to the cutout portion 36 of outer suede leather surface 30 so that the metallic cord 40 surrounds the entire exterior circumference of the top suede leather surface 30 and a portion of the foam core 20. This is also illustrated in FIG. 12.

Figure 11:
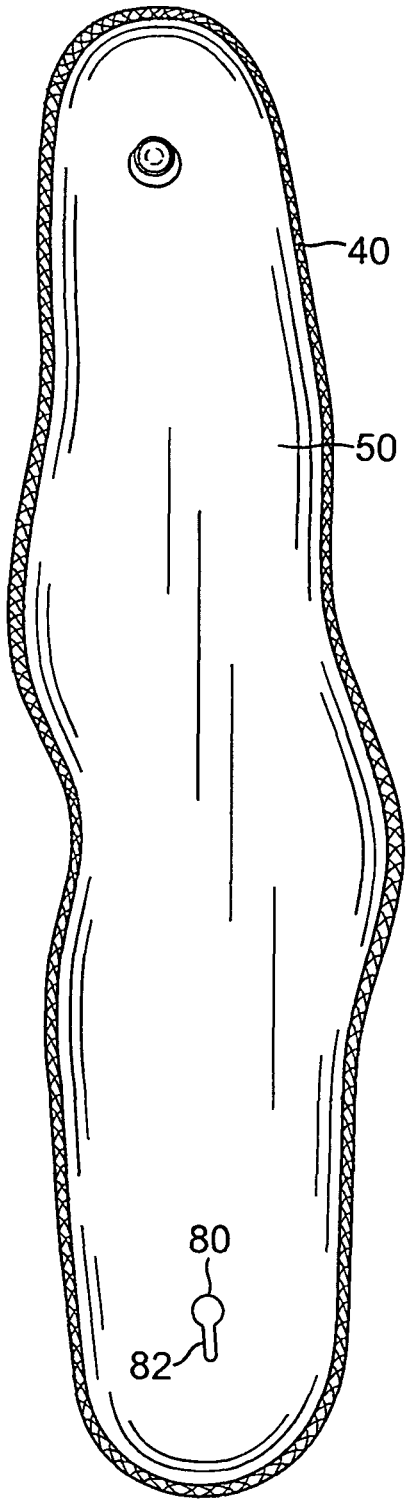
FIG. 11 is a bottom plan view illustrating another hole with a key shape punched through the top suede leather surface, through the foam core, through the reconstituted leather board core and through the bottom suede leather surface.

Referring to FIG. 11, another hole 80 with a key slot 82 is then punched through the top suede leather 30, through the foam core 20, through the reconstituted leather board 10 and through the bottom suede leather surface 50.

Figure 12:
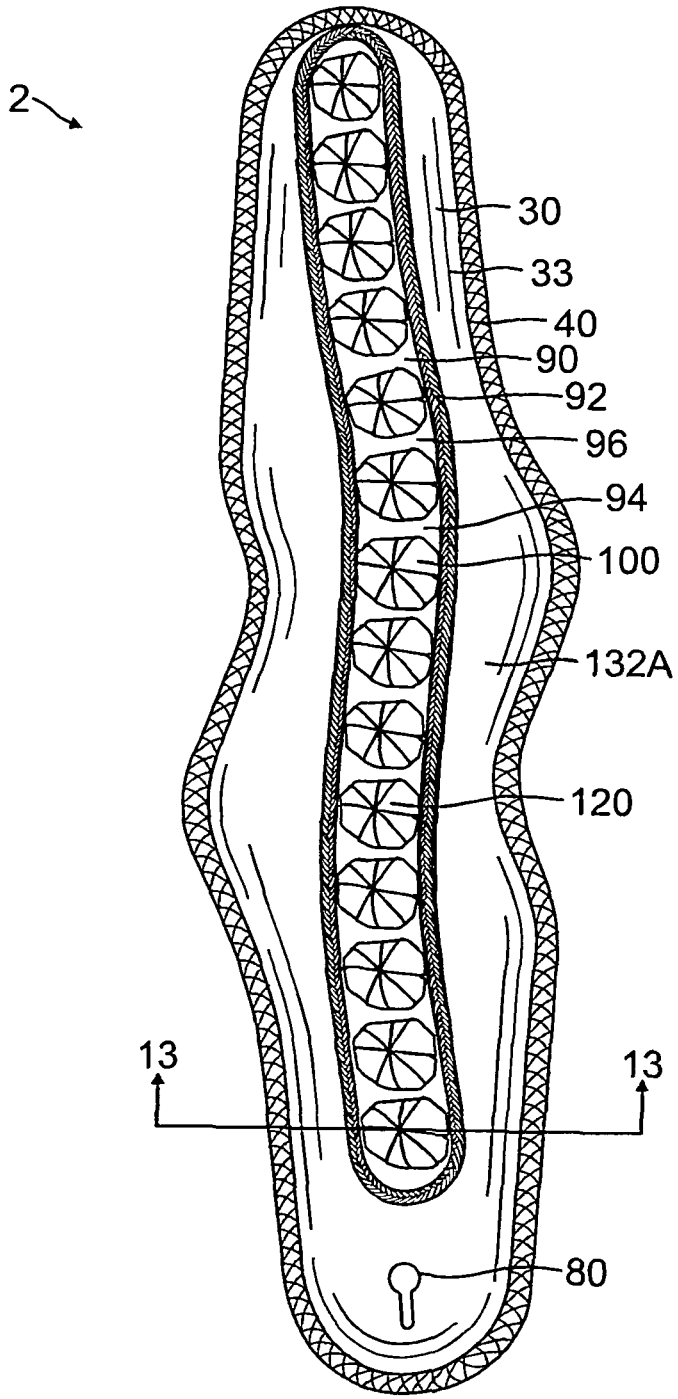
FIG. 12 is a top plan view of the cuff with a decorative upper suede leather ornamental piece with a rat tail cord affixed to its circumference by affixation means with the decorative ornamental piece affixed to the upper top surface of top suede leather surface and with additional decorative ornamentation such as a multiplicity of pearls affixed to the upper surface of decorative suede leather ornamentation piece.

Referring to FIG. 12, a decorative upper suede leather ornamental piece 90 with a rat tail cord 92 affixed to its circumference by affixation means such as sewing or glueing is then affixed to the upper top surface 33 of top suede leather surface 30 by affixation means such as glue. Additional decorative ornamentation such as a multiplicity of pearls 100 is then affixed to the upper surface 96 of decorative suede leather ornamental piece 90.

Figure 13:
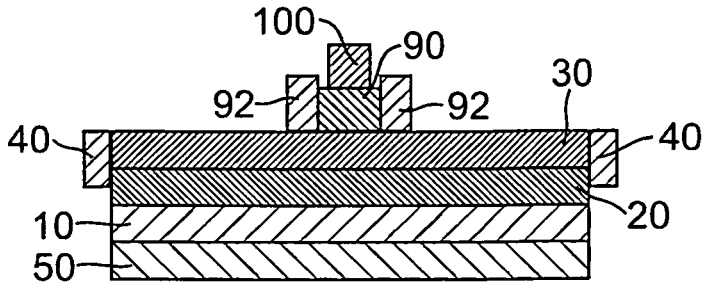
FIG. 13 is a cross-sectional view taken along line 13-13 of FIG. 12 to show all of the components of the present invention cuff jewelry piece except for the closure mechanism.

FIG. 13 is a cross-sectional view taken along line 13-13 of FIG. 12 to show all of the components of the present invention cuff 2 jewelry piece except for the closure mechanism. The components include the pearl ornamentation 100, the decorative ornamentation suede leather piece 90 surrounded by the rat tail cord 92, the top suede leather piece 30, the interior foam core 20, the reconstituted leather board core 10, the bottom suede leather piece 50, the top suede leather piece 30 and the upper portion of foam core 20 surrounded by the silver metallic cord 40.

Figure 14:
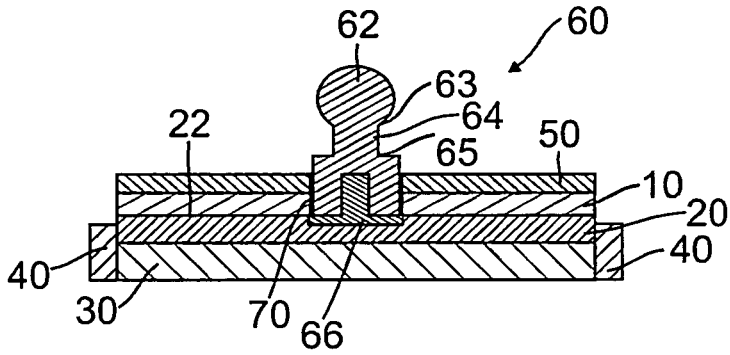
FIG. 14 is a cross-sectional view taken along line 14-14 of FIG. 4 to illustrate the button stud closing member and its component parts extending through the bottom suede leather surface, extending through the reconstituted leather board core, and hidden by the foam core section and the upper surface suede leather.

FIG. 14 is a cross-sectional view taken along line 14-14 of FIG. 4 to illustrate the button stud closure member 60 and its component parts extending through bottom suede leather surface 50, extending through reconstituted leather board 10, hidden by foam core 20 and upper surface 30.

Figure 15:
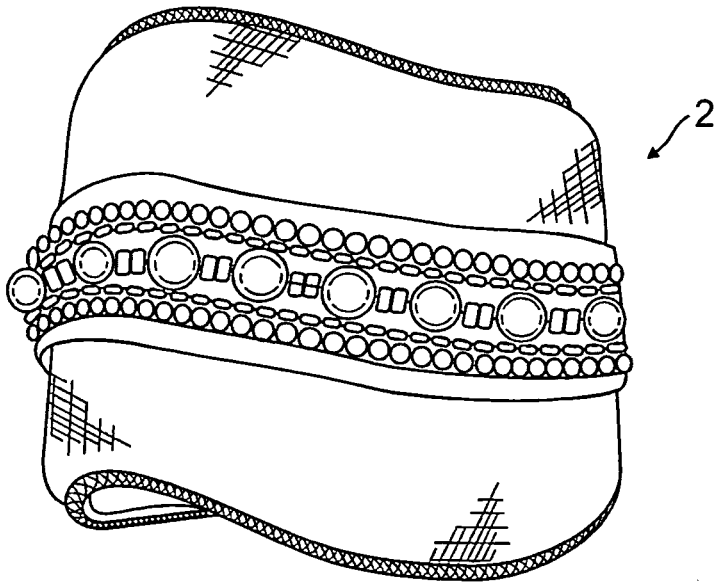
FIG. 15 is a perspective view of the cuff in the closed condition.

Referring to FIG. 15, ball head 62 of ball head closing member 60 is press fitted through second opening 80 through key opening 82 so that the ball head lies within the cuff 2 and is hidden from view while the cuff illustrated in FIG. 15 is formed into a closed cylinder which encircles a person's wrist.

Figure 16:
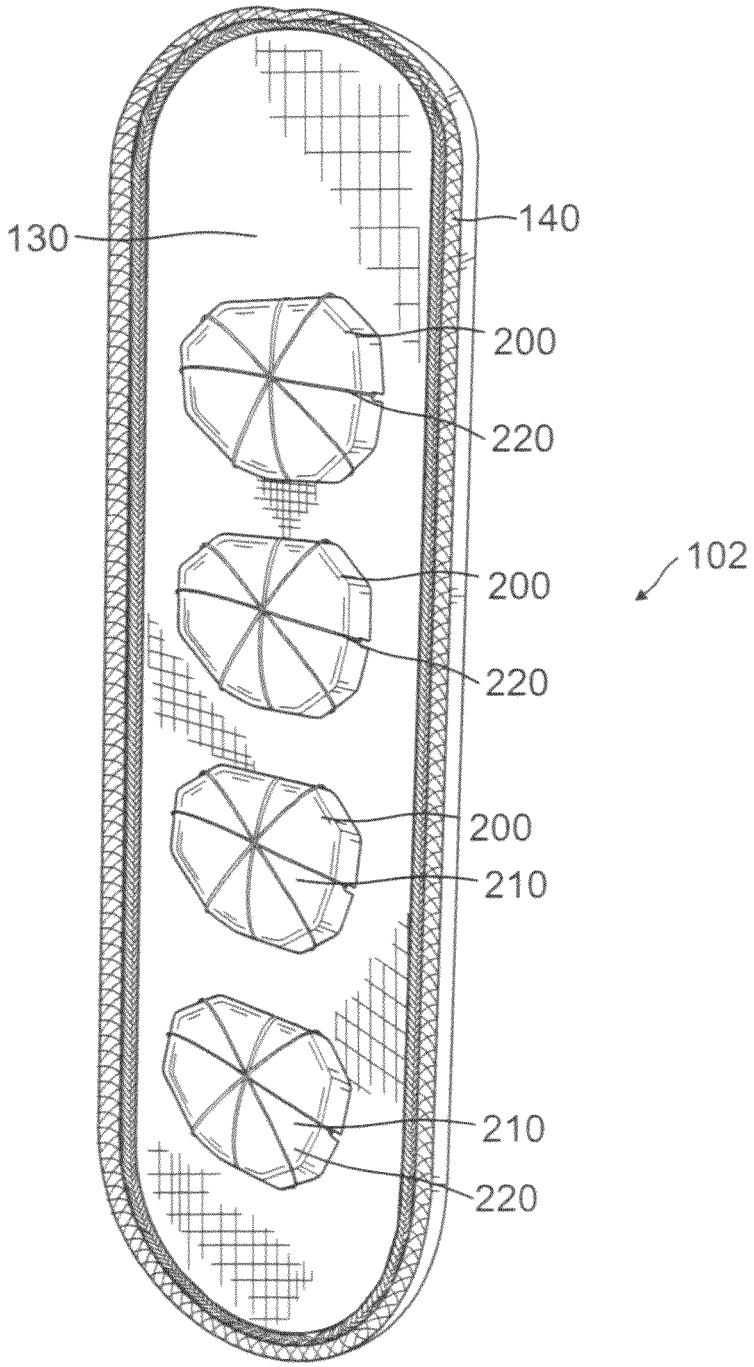
FIG. 16 is a top perspective view of an alternative embodiment of the cuff with the same components as the first embodiment but with different turquoise stone decorations affixed to the top surface of the cuff.
Figure 17:
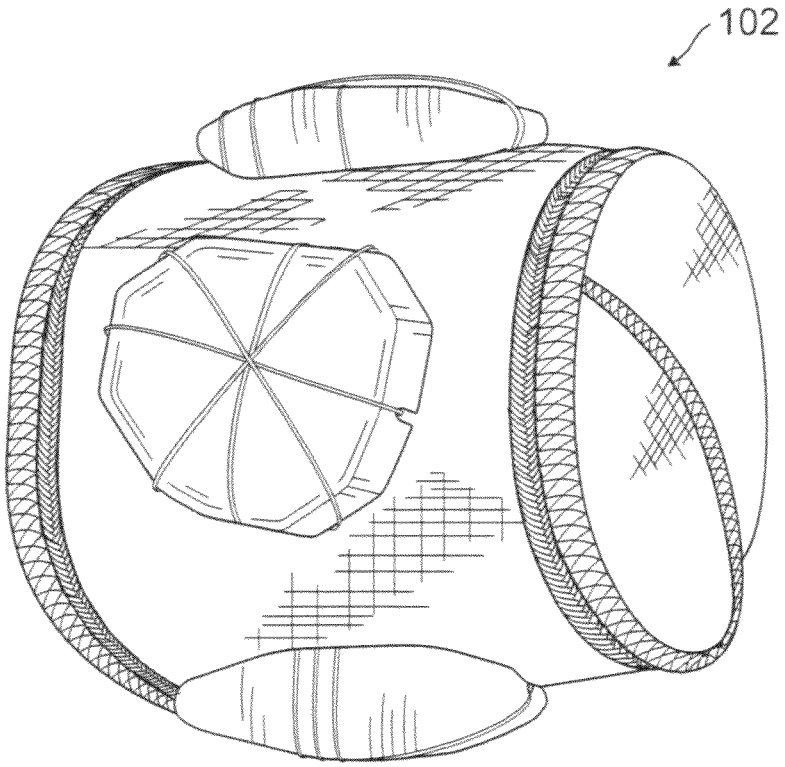
FIG. 17 is a perspective view of the alternative embodiment of the cuff in the closed condition.

An alternative variation of the present invention cuff 102 is illustrated in FIG. 16. All of the components including the upper suede leather surface 130, an interior foam core, an interior reconstituted leather board core, a bottom suede leather surface, and a silver ornamental metallic cord 140 encircling all components is the same as the first embodiment cuff 2. Here the decorative features are stones 200 such as turquoise stones which are affixed to the upper surface 33 of upper suede leather top 130 by affixation means such as strong sewing thread 210 and/or 220 sewn through the top suede leather surface 130, through the foam core and into the reconstituted leather board and as illustrated in FIG. 17, retained by a comparable ball head closing button inserted through an oppositely disposed hole extending through all layers of the cuff 102 to form a generally cylindrical cuff.

Broadly described, the cuff is a decorative wearing accessory. The present invention incorporates the use of reconstituted leather board in decorative wearing accessories such as cuffs as discussed in detail above and the same principles are incorporated into other decorative wearing accessories such as belts, necklaces, hat bands, headbands, bracelets, decorative chokers, vests and other wearing accessories for personal use and adornment worn by both men and women.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A decorative cuff of a given shape, comprising:

a. an interior layer forming a reconstituted leather board core of a given thickness and which is cut into a shape of the cuff, an opening extending through the entire thickness of the reconstituted leather board core extending from an upper surface to a lower surface;

b. a closing ball shaped button including a ball head affixed to one end of a stem which in turn at a second end of the stem is affixed to a base having an interior cavity with a threaded interior opening, a threaded bolt having a base with a screwdriver opening extending to a stem having mating threads, the ball head and the stem of the ball head extending through an opening in the reconstituted leather board core from the upper surface of the reconstituted leather board core to the lower surface of the reconstituted leather board core, so that the stem of the threaded bolt and the ball head of the ball-shaped closing button extend away from the lower surface of the reconstituted leather board core, the base of the threaded bolt extending through to the upper surface of the reconstituted leather board core and the stem having mating threads of the threaded bolt is inserted into the threaded interior opening of the stem of the ball head so that the threads of the stem of the threaded bolt are threaded into the interior threads so that the base of the threaded bolt having a screwdriver opening are against the upper surface of the reconstituted leather board core;

c. a foam core which is formed in the same shape as the reconstituted leather board core is glued to the upper surface of the reconstituted leather board core so that the foam core conceals the base of the threaded bolt and the screwdriver opening of the base of the threaded bolt and of the base of the stem of the closing ball shaped button;

d. the combined reconstituted leather board core and glued on foam core are placed face down so that the foam core is against an interior surface of a top suede leather surface with a multiplicity of odd shaped cuts cut into the top suede leather surface to form cutout areas in the top suede leather surface to facilitate gluing of the top suede leather surface to the upper surface of the reconstituted leather board core with affixation means placed onto the cutout areas of an interior surface of the top suede leather surface so that the cutout areas are glued to the lower surface of the reconstituted leather board core;

e. a silver metal cord is glued around an exterior circumferential area of a top surface of the top suede leather surface so that the silver metal cord is entirely glued to the top surface of the top suede leather surface but a gap is between a rear portion of the silver metal cord and cutout areas which have been glued to the lower surface of the reconstituted leather board core;

f. a bottom suede leather surface has a hole which is fed onto and through the closing ball shaped button so that the hole in the bottom suede leather surface rests around the stem of the ball shaped closing button and is then rotated so that a circumference of the bottom suede leather surface is fed into the gap between a rear portion of the silver metal cord and the cutout areas and is glued in place by glue applied to an interior surface of the bottom suede leather surface and along the circumference of the bottom suede leather surface so that the bottom suede leather surface is glued onto the lower surface of the reconstituted leather board core and the cutout portion of the top suede leather surface, the silver metal cord is glued between the foam core and the top suede leather surface so that the silver metal cord surrounds the entire exterior circumference of the top suede leather surface and the bottom suede leather surface;

g. a second hole with a key slot is punched through the top suede leather surface through the foam core, through the reconstituted leather board core and through the bottom suede leather surface;

h. a decorative upper suede leather ornamental piece with a rat tail cord affixed to a circumference of the top suede leather surface by affixation means which includes additional decorative ornamentation which are a multiplicity of pearls which are affixed to an upper surface of the decorative upper suede leather ornamental piece; and i. the ball head of the closing ball shaped button is press fitted through the second hole through the key slot so that the ball head lies within the cuff and is hidden from view while the cuff is formed into a closed cylinder.

2. A decorative cuff of a given shape, comprising:

a. an interior layer forming a reconstituted leather board core of a given thickness and which is cut into a shape of the cuff, an opening extending through the entire thickness of the reconstituted leather board core extending from an upper surface to a lower surface;

b. a closing ball shaped button including a ball head affixed to one end of a stem which in turn at a second end of the stem is affixed to a base having an interior cavity with a threaded interior surface, opening, a threaded bolt having a base with a screwdriver opening extending to a stem having mating threads, the ball head and the stem of the ball head extending through an opening in the reconstituted leather board core from a top the upper surface of the reconstituted leather board core to the lower surface of the reconstituted leather board core, to a rear surface so that the stem of the threaded bolt and the ball head of the ball-shaped closing button extend away from the lower surface of the reconstituted leather board core, the base of the threaded bolt extending through to the upper surface of the reconstituted leather board core and the stem having mating threads of the threaded bolt is inserted into the threaded interior opening of the stem of the ball head so that the threads of the stem of the threaded bolt are threaded into the interior threads so that the base of the threaded bolt having a screwdriver opening are against the upper surface of the reconstituted leather board core;

c. a foam core which is formed in the same shape as the reconstituted leather board core is glued to the upper surface of the reconstituted leather board core so that the core conceals the base of the threaded bolt and the screwdriver opening of the base of the threaded bolt and of the base of the stem of the closing ball shaped button;

d. the combined reconstituted leather board core and glued on foam core are placed face down so that the foam core is against an interior surface of a top suede leather surface with a multiplicity of odd shaped cuts cut into the top suede leather surface to form cutout areas in the top suede leather surface to facilitate gluing of the top suede leather surface to the upper surface of the reconstituted leather board core with affixation means placed onto the cutout areas of an interior surface of the top suede leather surface so that the cutout areas are glued to the lower surface of the reconstituted leather board core;

e. a bottom suede leather surface has a hole which is fed onto and through the closing ball shaped button so that the hole in the bottom suede leather surface rests around the stem of the ball shaped closing button and is then rotated so that a circumference of the bottom suede leather surface is fed into the gap between a rear portion of a silver metal cord and the cutout areas and is glued in place by glue applied to an interior surface of the bottom suede leather surface and along the circumference of the bottom suede leather surface so that the bottom suede leather surface is glued onto the lower surface of the reconstituted leather board core and the cutout portion of the top suede leather surface, the silver metal cord is glued between the foam core and the top suede leather surface so that the silver metal cord surrounds the entire exterior circumference of the top suede leather surface and the bottom suede leather surface;

f. a second hole with a key slot is punched through the top suede leather surface through the foam core, through the reconstituted leather board core and through the bottom suede leather surface; and g. the ball head of the closing ball shaped button is press fitted through the second hole through the key slot so that the ball head lies within the cuff and is hidden from view while the cuff is formed into a closed cylinder.

3. A decorative cuff of a given shape, comprising:

a. an interior layer forming a reconstituted leather board core of a given thickness and which is cut into a shape of the cuff, an opening extending through the entire thickness of the reconstituted leather board core extending from an upper surface to a lower surface;

b. a closing ball shaped button including a ball head affixed to one end of a stem which in turn at a second end of the stem is affixed to a base having an interior cavity with a threaded interior opening, a threaded bolt having a base with a screwdriver opening extending to a stem having mating threads, the ball head and the stem of the ball head extending through an opening in the reconstituted leather board core from the upper surface of the reconstituted leather board to the lower surface of the reconstituted leather board core, so that the stem of the threaded bolt and the ball head of the ball-shaped closing button extend away from the lower surface of the reconstituted leather board core, the base of the threaded bolt extending through to the upper surface of the reconstituted leather board core and the stem having mating threads of the threaded bolt is inserted into the threaded interior opening of the stem of the ball head so that the threads of the stem of the threaded bolt are threaded into the interior threads so that the base of the threaded bolt having a screwdriver opening are against the upper surface of the reconstituted leather board core;

c. a core which is formed in the same shape as the reconstituted leather board core is glued to the upper surface of the reconstituted leather board core so that the core conceals the base of the threaded bolt and the screwdriver opening of the base of the threaded bolt and of the base of the stem of the closing ball shaped button;

d. the reconstituted leather board core is placed down so that the reconstituted leather board core is against an interior surface of a top suede leather surface;

e. a silver metal cord is glued around an exterior circumferential area of a top surface of the top suede leather surface so that the silver metal cord is entirely glued to the top surface of the top suede leather surface but a gap is between a rear portion of the silver metal cord and cutout areas which have been glued to the lower surface of the reconstituted leather board core and the cutout areas and is glued in place by glue applied to an interior surface of the bottom suede leather surface and along the circumference of the bottom suede leather surface so that the bottom suede leather surface is glued onto the lower surface of the reconstituted leather board core and the cutout portion of the top suede leather surface the silver metal cord is glued between the foam core and the top suede leather surface so that the silver metal cord surrounds the entire exterior circumference of the top suede leather surface and the bottom suede leather surface;

f. a second hole with a key slot is punched through the top suede leather surface through the core, through the reconstituted leather board core and through the bottom suede leather surface; and g. the ball head of the closing ball shaped button is press fitted through the second hole through the key slot so that the ball head lies within the cuff and is hidden from view while the cuff is formed into a closed cylinder.

* * * * *